US005506568A

United States Patent [19]

Chen

[11] Patent Number: 5,506,568

[45] Date of Patent: Apr. 9, 1996

[54] SHOCK SENSOR

[75] Inventor: Chau-Ho Chen, Taichur, Taiwan

[73] Assignee: Nutek Corporation, Taipei, Taiwan

[21] Appl. No.: 449,481

[22] Filed: May 30, 1995

[51] Int. Cl.[6] ..... G08B 13/02

[52] U.S. Cl. ..... 340/566; 307/117; 340/429

[58] Field of Search ..... 340/566, 429; 307/117

[56] References Cited

U.S. PATENT DOCUMENTS 5,323,141 6/1994 Petek ..... 340/566

5,376,919 12/1994 Rickman ..... 340/566

*Primary Examiner*—Glen Swann

*Attorney, Agent, or Firm*—John J. Murphey; Murphey Law Offices

[57] ABSTRACT

A shock sensor includes a mass suspended in a flexible support arranged to resonate when subjected to a mechanical shock, a microphone spaced closely to the mass, the mass and microphone forming a first air pressure chamber with the flexible support for transmittal therethrough of air pressure waves from the resonating mass to the microphone, the microphone arranged to produce an electronic signal when it detects changes in air pressure from the pressure waves traveling through the chamber.

26 Claims, 2 Drawing Sheets

SHOCK SENSOR

BACKGROUND OF THE INVENTION

1. Field of the Invention

This invention pertains to the field of security devices. More particularly, this invention pertains to security systems for motor vehicles that can distinguish between attempted break-ins and the sound from thunder, voices and the shock from passing vehicles to provide a more reliable indication of an existing security breach.

2. Description of the Prior Art

Virtually all breaches into secured areas, such as to a home, office or automobile, involve an intrusion or invasion into the protected area. The burglar or vandal physically enters the secured area to either damage the interior or remove some valuables or, in the case of automobiles, to literally steal them. The prior art has developed numerous security systems for detecting these intrusions. Many of the more sophisticated systems employ a device known as a "shock sensor" that detects the incoming shock or noise accompanying the intrusion and converts it to electrical signals that are processed by a miniature electronic circuit to eventually trigger an alarm.

The prior art of shock sensors is well-developed. One type incorporates a mechanical spring and relay to detect the motion or shock, however it is rather crude in design and has generally been abandoned. Another type incorporates a magnet suspended in or near a coil of wire on a rubber band. In operation the magnet is jiggled under the influence of a shock and vibrates near the coil to generate a voltage therein. Another type of shock sensor uses a piezo element and spring to accomplish the same task. Still another type uses a microphone to listen for the sound of entry, such as the sound of breaking glass, and another type of shock sensor uses a microphone to detect the air pressure change in the interior of the vehicle when the burglar enters the passenger compartment. All of these devices generate an electric pulse that is processed by other electronics to trigger the alarm.

There is, however, a problem encountered with security devices that remains, for the most part, unsolved and that is the false signals issued by the shock sensor when the automobile is subjected to a non-intrusive shock. These non-intrusive shocks can come from a wide variety of sources. For instance, during storms, claps of thunder or peals of thunder impart a shock to the vehicle that will cause most shock sensors to issue a pulse or signal indicating an intrusion has occurred. A gusty wind against the automobile can produce the same false signal. In addition, if the automobile is parked along a busy street, vibration from a passing truck will also appear as an intrusive shock. The same phenomenon occurs when someone shouts near an automobile.

In dealing with this problem, the prior art has attempted to use two microphones, one installed inside the passenger compartment and the other installed outside the compartment. If both microphones pick up the same shock, then they cancel each other and no warning signal is issued. However, this design requires more components than normal, a longer installation time, more testing and more "tuning" of the circuitry and higher-than-normal maintenance. Accordingly, at present, there is no effective shock sensor that can discriminate between an intrusive and a non-intrusive shock without incorporating a very complicated system of components.

SUMMARY OF THE INVENTION

This invention is a novel shock sensor for mounting inside the passenger compartment of a motor vehicle that can detect the difference between intrusive and non-intrusive shocks. It uses a single microphone, mounted in an air chamber, to detect pressure waves created by a resonating mass suspended apart from its center of gravity in a flexible support that forms part of the air chamber. The shock sensor of this invention uses the closed environment of the air chamber to avoid any noise, voice interference or other non-intrusive shocks to the vehicle. The microphone generates an electric pulse in response to the pressure waves that are generated in the air chamber, said electric pulse being processed by an electronic circuit that sends a signal to a processor and eventually to an alarm that produces a warning sound representing the occurrence of a valid intrusion.

Accordingly, the main object of this invention is a single microphone, housed in an air chamber, that can distinguish between an intrusive shock and a non-intrusive shock so as to provide a reliable indication of a breach of security to the vehicle. Other objects include a shock sensor, housed in an air chamber, and surrounded by a second air chamber, constructed of relatively few parts and housed in a protective case that is small enough to be installed in many out-of-the-way places throughout the passenger compartment; a shock sensor that requires little installation effort, is low maintenance, and does not represent a significant drain to the vehicle's electric system; a device that is simple in design, rugged in manufacture, easy in use and may be installed with minimum effort using low-skilled personnel; and, a device that utilizes little material so that it does not adversely impact the environment. These and other objects of the invention will become more apparent when reading the description of the preferred embodiment along with the drawings that are appended hereto. The protection sought by the inventor may be gleaned from a fair reading of the claims that conclude this specification.

DESCRIPTION OF THE PREFERRED EMBODIMENT

Figure 1:
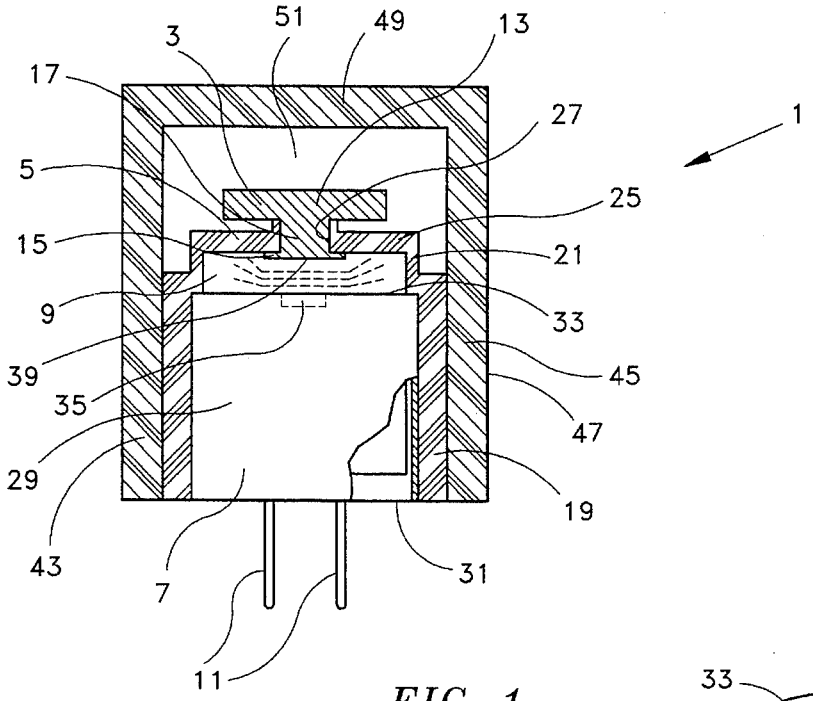
FIG. 1 is a sectional side view, taken along lines 1—1 in FIG. 3, showing the preferred embodiment of this invention.

Turning now to the drawings where like elements are identified with like numerals throughout the four figures, FIG. 1 shows the preferred embodiment of the invention 1 to comprise a mass or weight 3, preferably made of brass or other metal, suspended in a flexible support 5 and arranged to resonate when subjected to a mechanical shock. A microphone 7 is spaced close to a portion of mass 3. Both mass 3 and microphone 7 form part of a first air chamber 9 and pressure waves generated by mass 3 are transmitted through the air in chamber 9 and later picked up by microphone 7 to generate a pulse at microphone output pins 11 thereof. The pulse is processed by the printed circuit board shown in FIG.

2 resulting in an output signal that trips an alarm (not shown).

Figure 3:
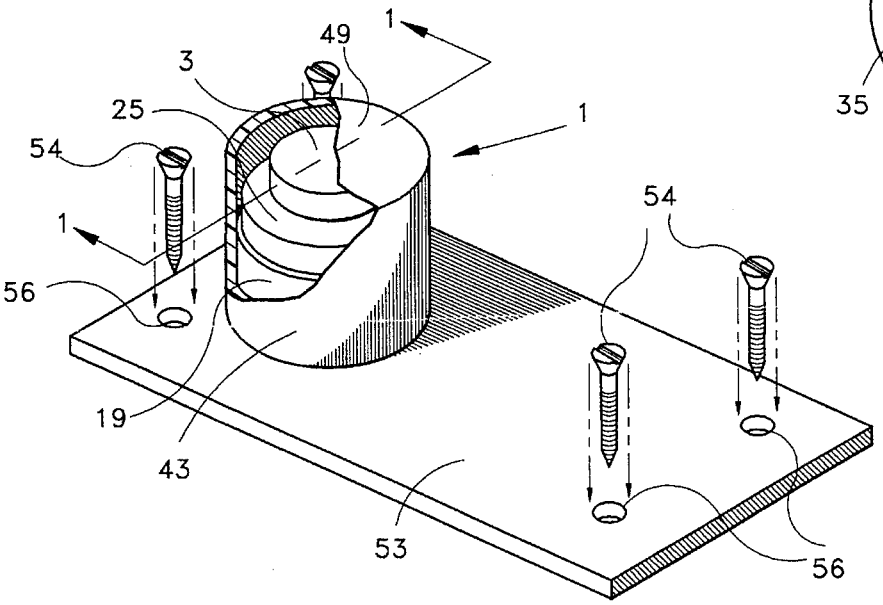
FIG. 3 is a trimetric view of the invention mounted on the printed circuit board for installation in the passenger compartment of an automobile; and, FIG. 4 is a top view of the typical microphone used in this invention.

Mass 3 comprises a large mass portion 13, spaced apart from a smaller mass portion 15, interconnected thereto by a narrow, elongated, connecting portion 17. This construction renders mass 3 heavy on one side of connecting portion 17 and asymmetrical thereabout so that it is mounted spaced apart from its center of gravity, which would be in or nearer to large mass portion 13 than connecting portion 17. This mounting design results in mass 3 being easily excited to its resonance frequency when subject to an incoming shock delivered from any direction. Typical resonating frequencies for masses mounted in this manner range from 30–70 Hz. Mass 3 is preferably fashioned in a round much like a coin, as shown in FIG. 3. In addition, small mass portion 15 is also preferably formed into a round but has a smaller diameter than large mass portion 13. Accordingly, small mass portion 15 acts to generate air pressure waves in chamber 9 when the entire mass is resonating; the waves are shown in dotted lines in FIG. 1.

Flexible support 5 is preferably made of thin-walled silicone rubber and cast into the shape shown in FIG. 1. This shape includes a lower, cylindrical wall portion 19, an upper, narrower cylindrical wall portion 21 attached around the upper perimeter edge of lower cylindrical wall portion 19, and a top wall portion 25 extending from the top perimeter of upper narrower cylindrical wall portion 21 toward the middle to a small aperture 27 centrally formed therein for receipt therethrough of narrow, elongated connecting mass portion 17. In this configuration, mass 3 is centrally suspended in top wall 25 so as to provide the maximum resonating movement therein.

Figure 4:
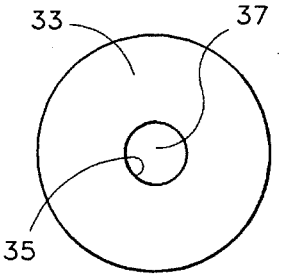

Microphone 7 is preferably of the "electret" type and especially an electret-condenser type of miniature microphone. An example of such a microphone is a number 034, 10 mm diameter electret microphone available from Panasonic. As shown in FIGS. 1 and 4, microphone 7 has an outer metal jacket 29 surrounding the cylindrical sides thereof, bottom 31 and top 33 and further has formed in said top 33 an aperture 35. Below aperture 35, inside microphone 7, can be seen one plate 37 of a capacitor that resides in said microphone. Pressure waves generated at the face 39 of small mass portion 15 pass across the air space and enter aperture 35 and strike plate 37 and move it to change the capacitance of the capacitor inside said microphone to produce the electric pulse at pins 11. Metal jacket 29 is of a size and shape to fit snugly into lower, cylindrical wall portion 19 of flexible support 5.

Microphone top wall portion 33 forms the lower interior wall of first air chamber 9 that is further formed by the interior surface of upper cylindrical wall portion 21 of flexible support 5, the interior surface of transverse top wall portion 25, and face 39 of small mass portion 15. This air chamber 9 is sealed from outside air. Mass 3, flexible support 5, and microphone 7 are all encapsulated in an outer hard shell or case 43. Case 43 is formed of plastic and contains a cylindrical side wall 45 that reposes against lower cylindrical wall portion 19 and contains a transverse closure top 49 as shown in FIGS. 1 and 3. A second air chamber 51 is formed between case 43 and flexible support 5 above lower cylindrical side wall portion 19. First and second air chambers 9 and 51 respectively are separated from each other by flexible support 5 and mass 3.

In this design, second air chamber 51 insulates mass 3 and first air chamber 9 and attenuates sounds and shocks from non-intrusive elements such as thunder, noise and shocks from passing vehicles. Since mass 3 does not receive these non-intrusive shocks and noise, any resonance, and hence any electrical pulses, will be generated solely by intrusive or invasive shocks.

Figure 2:
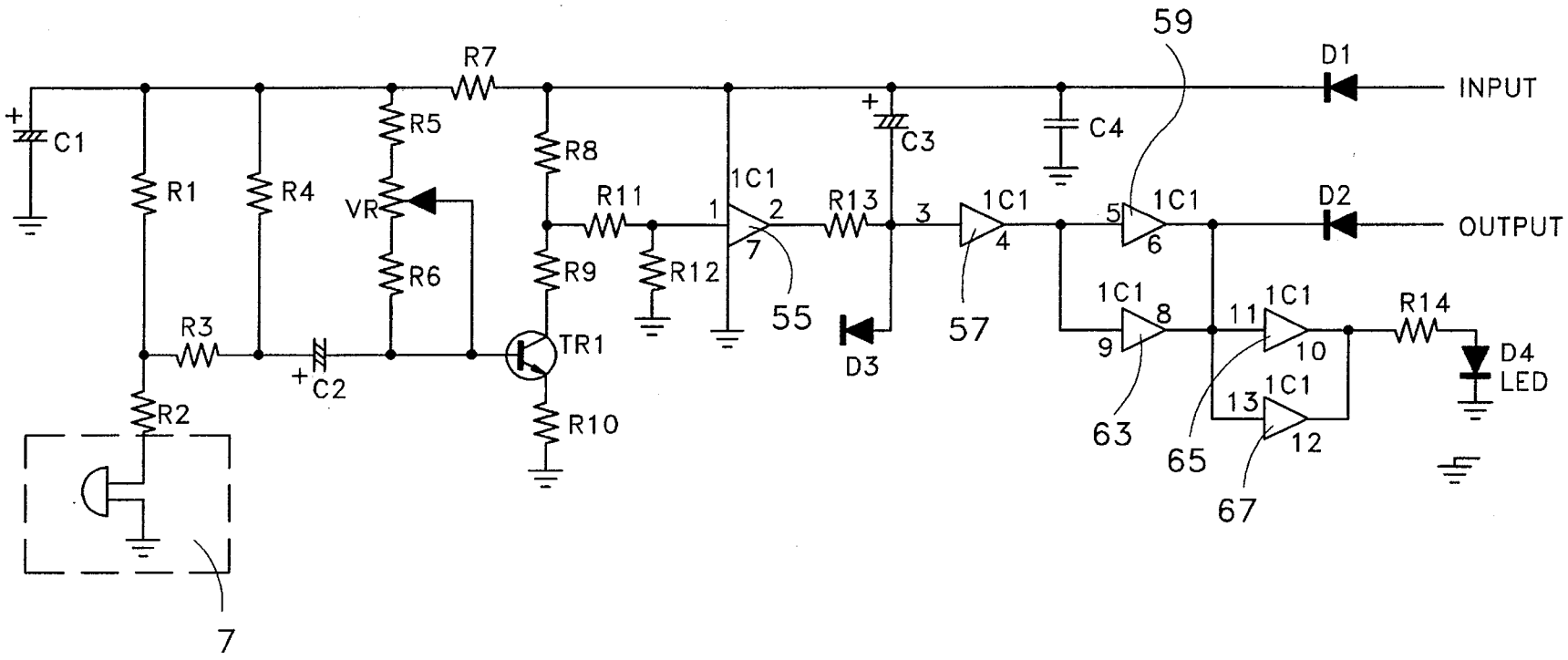
FIG. 2 is a schematic diagram of the printed circuit board to which the shock sensor of FIG. 1 is attached for processing the electronic signal generated at the microphone.

As shown in FIG. 2, an electrical circuit is provided for processing the electrical signals generated by microphone 7. This circuit is conveniently contained on a printed circuit board or PCB 53 (see FIG. 3) on which are mounted a series of components including diodes, resistors, capacitors, transistors, etc. The solid lines between these components refer to conductors and will not be individually numbered except where necessary. Where conductors cross and the intersection is marked with a dot or period, it is a junction between them; where one conductor crosses another and the intersection has no dot, there is no junction. Transistors are marked with a number beginning with "TR"; resistors with a number beginning with "R"; capacitors with "C"; diodes with "D"; and, integrated chips or gates with "IC". Further, reference will be made to "high" and "low" signals. These are respectively direct current voltages from 8 to 12 volts and 0 to 5 volts. This is common in the art.

In the circuit shown in FIG. 2, 12 volts d.c. is applied to the "INPUT". Accordingly, the output from microphone 7 (microphone 7 is shown in dotted outline) remains low. In addition, when the "OUTPUT" is high, the diode D4 LED is not lit and is low. Upon receipt of a shock to mass 3, said mass begins to resonate and generate air pressure waves at small mass portion 15 and its face 39. These pressure waves travel across first air chamber 9 and enter microphone aperture 35. Plate 37 and microphone 7 is disturbed by these pressure waves and produces a high signal emanating from pins 11. This high signal is passed to the base of an NPN transistor TR1 and generates a low signal at pin 1 of gate 55. This signal is then inverted in gate 55 and leaves pin 2 as a low. This low signal is again inverted at gate 57 to a high signal and again inverted at gate 59 to a low signal that appears at "OUTPUT" which is the required signal to trigger an alarm.

Diode D1 and capacitor C4 constitute a filter cap and reverse protection power supply. Polarized capacitor Cl is a noise filter. Resistor R4 and capacitor C2 act as a band pass filter. The combination of resistors R5 and R6, plus the variable resistor VR, operates to set the bias voltage of the base of transistor TR1. Air pressure waves of a magnitude sufficient to produce a high signal above the level of the voltage bias set by R5, R6 and VR will immediately change the high at "OUTPUT" to a low signal.

The combination of resistor R13 and diode D3 operates to stretch out the pulse produced by microphone 7. A separate gate 63 is paralleled with gate 59 to increase the power output to help light up the LED indicator showing that a shock was detected. A pair of invertor gates, 65 and 67, are paralleled from the "OUTPUT" to drive and light the LED with a high signal.

As shown in FIG. 3, invention 1 may be conveniently attached to PCB 53 by known manner and PCB 53 mounted in out-of-the-way locations in the passenger compartment of the automobile such as by machine screws 54 passing through apertures 56 in PCB 53 as shown in FIG. 3. Once it is mounted, invention 1 will operate thereafter with little or no maintenance.

VALUES OF CAPACITORS AND RESISTORS IN FIGURE 2

$C_1=10\mu$
$C_2=1\mu$ $C_3$=4.7μ
$C_4$=0.1μ
$R_1$=100 KΩ
$R_2$=10 KΩ
$R_3$=10 KΩ
$R_4$=22 KΩ
$R_5$=1 MΩ
$R_6$=1Ω
$R_7$=4.7 KΩ
$R_8$=1 MΩ
$R_9$=470 KΩ
$R_{10}$=10 KΩ
$R_{11}$=10 KΩ
$R_{12}$=5.6 MΩ
$R_{13}$=220 KΩ
$R_4$=330 KΩ

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the way to achieve substantially the same result are within the scope of this invention.

What is claimed is:

1. A shock sensor comprising:

a) a mass suspended in a flexible support arranged to resonate when subjected to a mechanical shock; and b) a microphone spaced closely to said mass, said mass and said microphone forming a first air pressure chamber with said flexible support for transmittal therethrough of air pressure waves from said resonating mass to said microphones, said microphone being arranged to produce an electronic signal when it detects changes in air pressure from the pressure waves traveling through said chamber.

2. The shock sensor of claim 1 further including an electronic circuit connected to said microphone for processing said signal to produce an alarm.

3. The shock sensor of claim 1 wherein said mass is asymmetrical to resonate upon receipt of a shock from any direction.

4. The shock sensor of claim 1 wherein said mass is suspended at a point spaced apart from its center of gravity.

5. The shock sensor of claim 1 wherein said mass comprises:

a) a large mass portion;

b) a smaller mass portion spaced apart from said large mass portion; and, c) a narrow, elongated, portion interconnecting said large mass portion and said smaller mass portion.

6. The shock sensor of claim 5 wherein said large mass portion is shaped as a round.

7. The shock sensor of claim 5 wherein said smaller mass portion is shaped as a round.

8. The shock sensor of claim 1 wherein said mass is centrally suspended over said microphone for transmission of maximum vibrations thereto.

9. The shock sensor of claim 1 wherein said mass and said microphone are arranged in spaced-apart, facing relationship.

10. The shock sensor of claim 1 wherein said mass forms the upper part of said first air chamber.

11. The shock sensor of claim 1 wherein said microphone is of the electret type.

12. The shock sensor of claim 1 wherein said microphone includes a variable capacitor mounted for receipt of air pressure waves emanating from said mass.

13. The shock sensor of claim 1 wherein said microphone closes off said air chamber to make it sealed from the outside.

14. The shock sensor of claim 1 wherein said microphone includes a hard, outer jacket and an aperture for receiving therethrough the pressure waves generated by said resonating mass.

15. The shock sensor of claim 1 wherein said microphone includes a pair of pins extending therefrom for carrying the signal produced upon receipt of the pressure waves from said resonating mass.

16. The shock sensor of claim 1 wherein said microphone forms the lower part of said first air chamber.

17. The shock sensor of claim 1 further including a protective case surrounding said sensor.

18. The shock sensor of claim 1 further including a second air chamber surrounding said first air chamber for insulating said mass from impact of shocks and sounds from non-intrusive events.

19. The shock sensor of claim 18 wherein said second air chamber is cylindrical in shape.

20. The shock sensor of claim 1 wherein said first air chamber is cylindrical in shape.

21. The shock sensor of claim 1 further including mounting hardware for mounting said sensor in the passenger compartment of said vehicle.

22. A method of indicating receipt of a shock from an intrusion into a protected area comprising the steps of:

a) suspending a mass in a flexible support in said area, so that it may mechanically resonate upon receipt of the shock thereto;

b) arranging said resonance to produce a series of air pressure waves; and, c) directing said air pressure waves to a microphone for generating an electrical signal in response thereto.

23. The method of claim 22 wherein said step of suspending a mass in a flexible support includes the step of arranging said mass in said flexible support to be supported at a point spaced apart from its center of gravity.

24. The method of claim 22 wherein said step of arranging said resonance to produce a series of air pressure waves includes the step of housing said mass in a first air chamber in close proximity to said microphone set in facing relationship thereto.

25. The method of claim 22 including the additional step of processing the electric signal produced by said microphone to a signal that indicates an intrusive event.

26. The method of claim 22 including the additional step of housing said first air chamber in a second air chamber, surrounding said first air chamber, to attenuate shocks from non-intrusive events from impacting said mass.

* * * * *